US008871049B2

(12) United States Patent
Lo

(10) Patent No.: US 8,871,049 B2
(45) Date of Patent: Oct. 28, 2014

(54) METHOD OF MANUFACTURING RESISTOR

(71) Applicant: Cyntec Co., Ltd., Hsin-Chu (TW)

(72) Inventor: Ta-Wen Lo, Keelung (TW)

(73) Assignee: Cyntec Co., Ltd., Science-Based Industrial Park, Hsinchu (TW)

( * ) Notice: Subject to any disclaimer, the term of this patent is extended or adjusted under 35 U.S.C. 154(b) by 210 days.

(21) Appl. No.: 13/681,435

(22) Filed: Nov. 20, 2012

(65) Prior Publication Data

US 2013/0133826 A1 May 30, 2013

Related U.S. Application Data

(60) Provisional application No. 61/563,546, filed on Nov. 24, 2011.

(51) Int. Cl.
*H01C 17/28* (2006.01)
*H01C 1/144* (2006.01)

(52) U.S. Cl.
CPC ..... *H01C 17/28* (2013.01); *H01C 1/144* (2013.01)
USPC ..... 156/272.8

(58) Field of Classification Search
CPC ..... H01C 17/28; H01C 17/242; H01C 1/144; H01C 3/00; B23K 26/00
USPC ..... 156/272.2, 272.8
See application file for complete search history.

(56) References Cited

U.S. PATENT DOCUMENTS

2007/0159295 A1* 7/2007 Wang ..... 338/307

FOREIGN PATENT DOCUMENTS

| | | | |
|---|---|---|---|
| CN | 1319078 | C | 5/2007 |
| CN | 2899049 | Y | 5/2007 |
| CN | 201336194 | Y | 10/2009 |
| CN | 101587766 | A | 11/2009 |
| EP | 0605800 | B1 | 3/1996 |
| JP | 2009071123 | A | 4/2009 |

* cited by examiner

*Primary Examiner* — Daniel McNally
(74) *Attorney, Agent, or Firm* — Winston Hsu; Scott Margo

(57) ABSTRACT

A method of manufacturing a resistor includes steps of providing a resistance material and two electrode materials, wherein a reflectivity of the resistance material is smaller than a reflectivity of the electrode material; fixing the two electrode materials at opposite sides of the resistance material; and welding two first junctions between the resistance material and the two electrode materials by a first laser from a first side of the resistance material, wherein a beam area from the first laser to the resistance material is larger than a beam area from the first laser to the electrode material.

11 Claims, 6 Drawing Sheets

METHOD OF MANUFACTURING RESISTOR

CROSS REFERENCE TO RELATED APPLICATIONS

This application claims the benefit of U.S. Provisional Application No. 61/563,546, which was filed on Nov. 24, 2011, and is incorporated herein by reference.

BACKGROUND OF THE INVENTION

1. Field of the Invention

The invention relates to a method of manufacturing a resistor and, more particularly, to a method capable of enhancing laser welding intensity between resistance material and electrode material of a resistor effectively.

2. Description of the Prior Art

A conventional resistor is manufactured by welding two electrode materials at opposite sides of a resistance material. In general, copper is chosen to be the electrode material. Since copper has high reflectivity, light cannot be absorbed by copper well so that laser cannot be used to weld electrode material and resistance material. In prior art, a continuous electron beam is proposed to be used to weld resistance material and copper electrode so as to manufacture the resistor. However, the electron beam has some disadvantages as follows: first, the electron beam must be used in a vacuum chamber; second, the cost of using the electron beam is high; third, the electron beam generates X-rays; and fourth, a tool used with the electron beam cannot be magnetic.

SUMMARY OF THE INVENTION

An objective of the invention is to provide a method capable of enhancing laser welding intensity between resistance material and electrode material of a resistor effectively.

According to an embodiment of the invention, a method of manufacturing a resistor comprises steps of providing a resistance material and two electrode materials, wherein a reflectivity of the resistance material is smaller than a reflectivity of the electrode material; fixing the two electrode materials at opposite sides of the resistance material; and welding two first junctions between the resistance material and the two electrode materials by a first laser from a first side of the resistance material, wherein a beam area from the first laser to the resistance material is larger than a beam area from the first laser to the electrode material.

In this embodiment, the method of manufacturing the resistor may further comprise step of welding two second junctions between the resistance material and the two electrode materials by the first laser from a second side of the resistance material, wherein the second side is opposite to the first side.

In this embodiment, the method of manufacturing the resistor may further comprise steps of re-welding the two first junctions by a second laser from the first side; and re-welding the two second junctions by the second laser from the second side; wherein a beam area from the second laser to the resistance material is larger than a beam area from the second laser to the electrode material.

In this embodiment, a spot size of the first laser is smaller than a spot size of the second laser and an output power of the first laser is larger than an output power of the second laser.

According to another embodiment of the invention, a method of manufacturing a resistor comprises steps of providing a resistance material and two electrode materials; fixing the two electrode materials at opposite sides of the resistance material; welding two first junctions between the resistance material and the two electrode materials by a first laser from a first side of the resistance material; and welding two second junctions between the resistance material and the two electrode materials by the first laser from a second side of the resistance material, wherein the second side is opposite to the first side.

As mentioned in the above, when a laser is used to weld a junction between the resistance material and the electrode material, the invention proposes that the beam area from the laser to the resistance material is larger than the beam area from the laser to the electrode material. Since the reflectivity of the resistance material is smaller than the reflectivity of the electrode material, the resistance material with smaller reflectivity absorbs more laser energy and then transmits heat to the electrode material. The heat, which is transmitted to the electrode material from the resistance material, can be used with laser energy absorbed by the electrode material to weld the electrode material and the resistance material well. Accordingly, the method of the invention is capable of enhancing laser welding intensity between the resistance material and the electrode material of the resistor effectively. Furthermore, the invention can selectively weld the junctions between the resistance material and the electrode materials by the laser from one or two sides of the resistance material according to different resistance materials with different thicknesses, so as to enhance laser welding intensity between the resistance material and the electrode material. Moreover, if the resistance material has a large thickness (e.g. larger than 1 mm), the method of the invention may use a laser with small spot size and large output power to weld the junctions between the resistance material and the electrode materials first and then use another laser with large spot size and small output power to re-weld the junctions between the resistance material and the electrode materials, so as to ensure that the junctions have enough welding intensity and good surface flatness.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
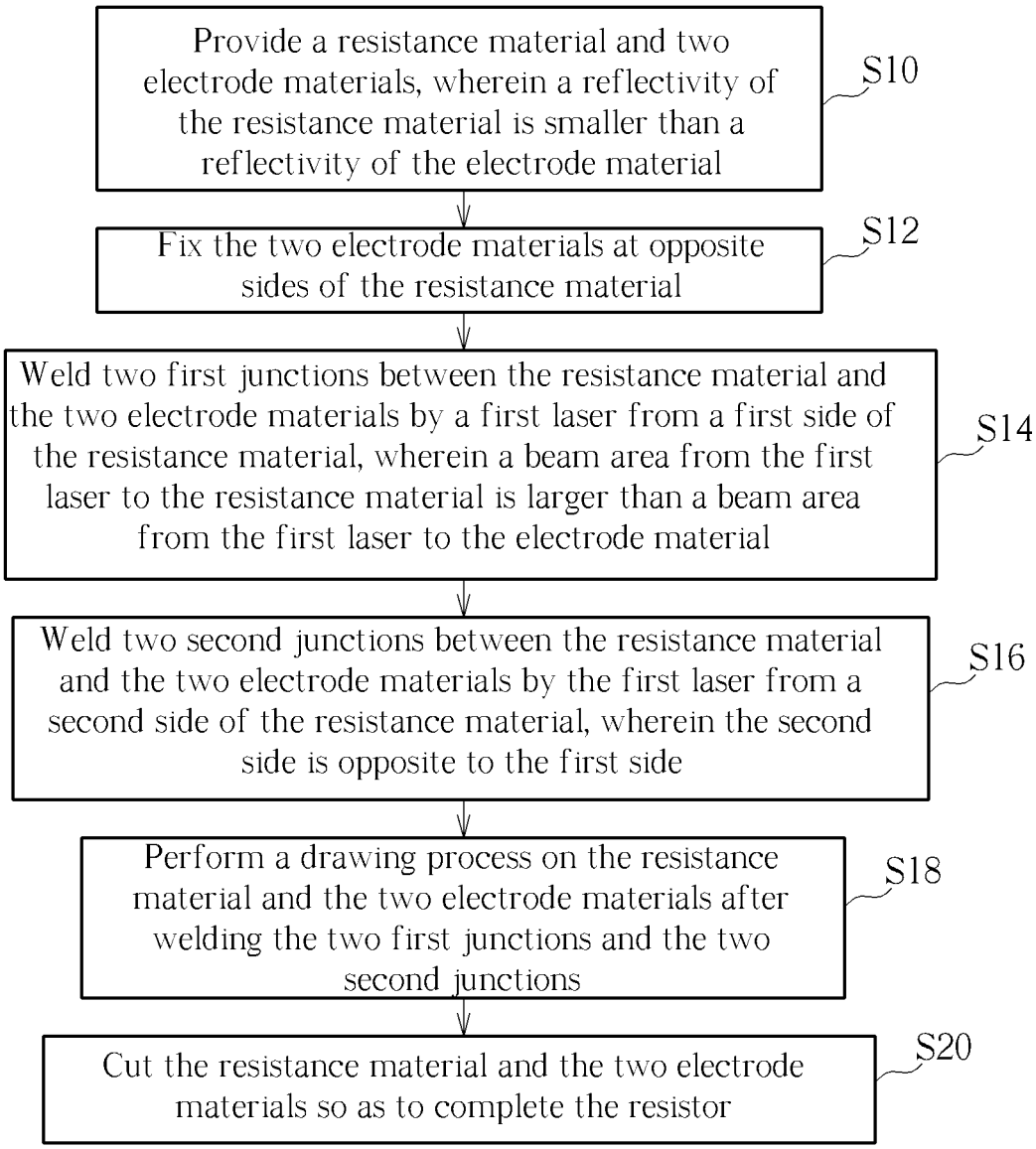
FIG. 1 is a flowchart illustrating a method of manufacturing a resistor according to an embodiment of the invention.
Figure 2A:
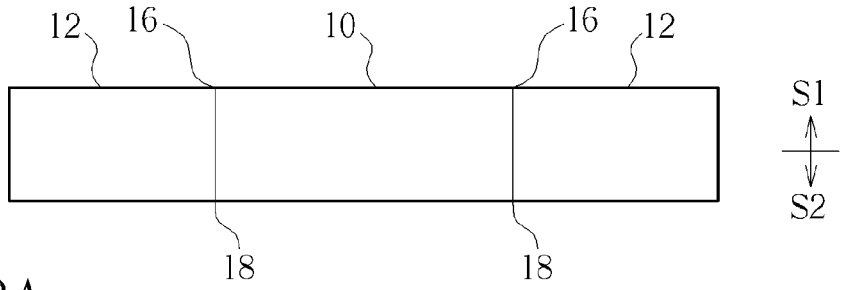
FIGS. 2A to 2D are schematic diagrams illustrating processes associated with the method shown in FIG. 1.
Figure 2B:
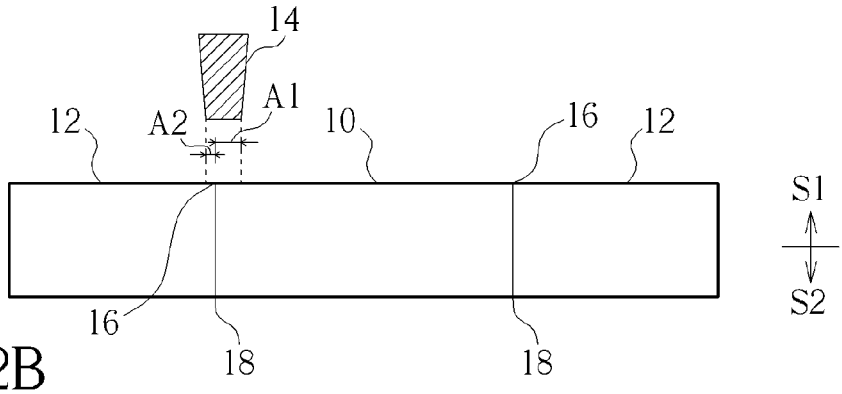
Figure 2C:
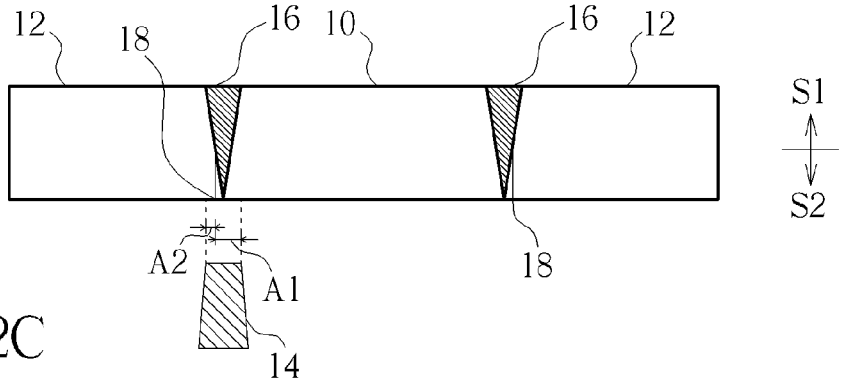
Figure 2D:
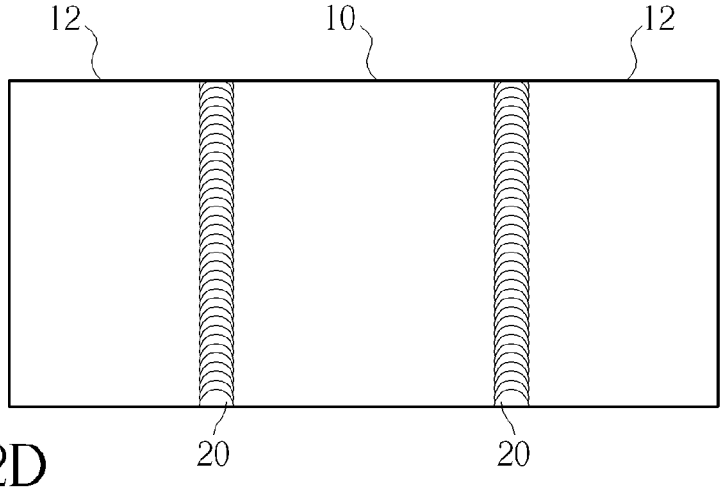
Figure 3:
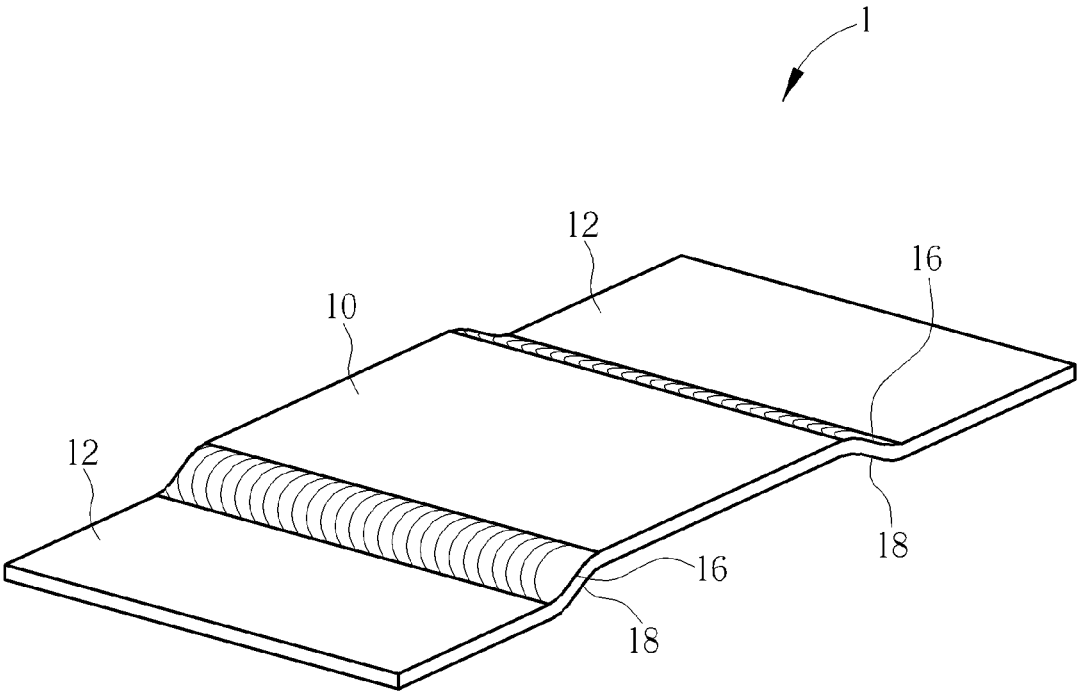
FIG. 3 is a perspective view illustrating a resistor manufactured by the method shown in FIG. 1.
Figure 4:
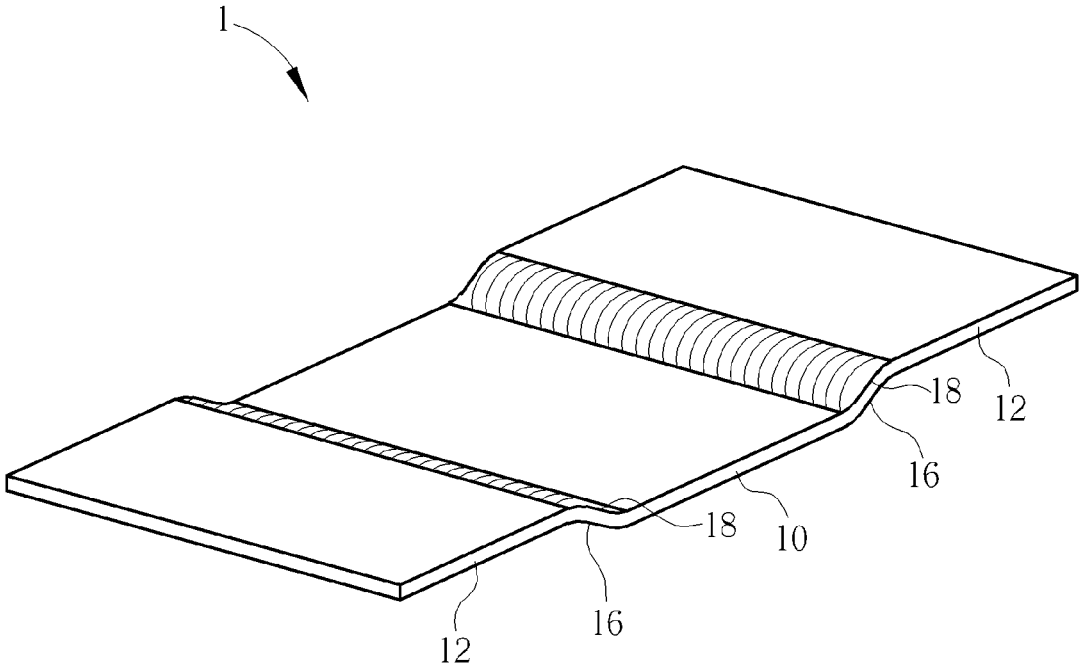
FIG. 4 is a perspective view illustrating the resistor shown in FIG. 3 from another viewing angle.

Referring to FIGS. 1 to 4, FIG. 1 is a flowchart illustrating a method of manufacturing a resistor according to an embodiment of the invention, FIGS. 2A to 2D are schematic diagrams illustrating processes associated with the method shown in FIG. 1, FIG. 3 is a perspective view illustrating a resistor 1 manufactured by the method shown in FIG. 1, and FIG. 4 is a perspective view illustrating the resistor 1 shown in FIG. 3 from another viewing angle. First of all, step S10 is performed to provide a resistance material 10 and two electrode materials 12 (as shown in FIG. 2A), wherein a reflectivity of the resistance material 10 is smaller than a reflectivity of the electrode material 12. In this embodiment, the resistance material 10 may be NiCu alloy, MnCu alloy, NiCr alloy, NiCrAlSi alloy, CuMnSn alloy and so on, and the electrode material 12 may be Cu, Cu coated solder and so on.

Afterward, step S12 is performed to fix the two electrode materials 12 at opposite sides of the resistance material 10, as shown in FIG. 2A. Step S14 is then performed to weld two first junctions 16 between the resistance material 10 and the two electrode materials 12 by a first laser 14 from a first side S1 of the resistance material 10, wherein a beam area A1 from the first laser 14 to the resistance material 10 is larger than a beam area A2 from the first laser 14 to the electrode material 12, as shown in FIG. 2B. Step S16 is then performed to weld two second junctions 18 between the resistance material 10 and the two electrode materials 12 by the first laser 14 from a second side S2 of the resistance material 10 (as shown in FIG. 2C), wherein the second side S2 is opposite to the first side S1. In step S16, the beam area A1 from the first laser 14 to the resistance material 10 is still larger than the beam area A2 from the first laser 14 to the electrode material 12. Since the reflectivity of the resistance material 10 is smaller than the reflectivity of the electrode material 12, the resistance material 10 with smaller reflectivity absorbs more laser energy and then transmits heat to the electrode material 12. The heat, which is transmitted to the electrode material 12 from the resistance material 10, can be used with laser energy absorbed by the electrode material 12 to weld the electrode material 12 and the resistance material 10 well.

In this embodiment, the first laser 14 may be a pulsed laser such that a fish-scale pattern is formed on each of the two first junctions 16 and the two second junctions 18 after welding. As shown in FIG. 2D, the fish-scale pattern consists of a plurality of molten spots 20 overlapping each other and an overlap rate of the molten spots 20 is smaller than 100% and larger than or equal to 50%. Preferably, the overlap rate of the molten spots 20 may be 70%. It should be noted that the overlap rate of the molten spots 20 can be adjusted according to a welding depth performed by the first laser 14 so it is not limited to 70%. In another embodiment, the first laser 14 may be a continuous laser so it is not limited to a pulsed laser.

Several parameters relative to the first laser 14 (e.g. spot size, laser intensity, pulsed frequency, output power, etc.) can be determined based on the resistance material 10 and the electrode materials 12. For example, if the resistance material 10 is MnCu alloy and the electrode materials 12 are Cu, the spot size, laser intensity, pulsed frequency and output power of the first laser 14 may be set to be 0.7 mm, 3.5 kW, 6.5 ms and 20 J, respectively, and a ratio of the beam area A1 to the beam area A2 may be set to be 7/3. When the resistance material 10 has a small thickness (e.g. smaller than 1 mm), the resistance material 10 and the electrode materials 12 can be fused well and the surface can have good flatness after welding the two first junctions 16 and the two second junctions 18 by the aforesaid steps S14 and S16.

Then, step S18 is performed to perform a drawing process on the resistance material 10 and the two electrode materials 12 after welding the two first junctions 16 and the two second junctions 18. After the drawing process, there is a height difference between the resistance material 10 and the electrode material 12. Finally, step S20 is performed to cut the resistance material 10 and the two electrode materials 12 so as to complete the resistor 1 shown in FIGS. 3 and 4. Since the method of the invention welds the two first junctions 16 and the two second junctions 18 from the first side S1 and the second side S2, respectively, the aforesaid fish-scale pattern is formed on each of the two first junctions 16 and the two second junctions 18 after welding.

It should be noted that when the resistance material 10 has a small thickness, the method of the invention may perform the drawing process on the resistance material 10 and the two electrode materials 12 (i.e. the aforesaid step S18) directly and cut the resistance material 10 and the two electrode materials 12 (i.e. the aforesaid step S20) after welding the two first junctions 16 (i.e. the aforesaid step S14) without welding the two second junctions 18 (i.e. the aforesaid step S16).

Furthermore, in step S10, if the thickness of the electrode material 12 is larger than the thickness of the resistance material 10, the method of the invention may cut the resistance material 10 and the two electrode materials 12 (i.e. the aforesaid step S20) directly after welding the two first junctions 16 and the two second junctions 18 (i.e. the aforesaid steps S14 and S16) without performing the drawing process on the resistance material 10 and the two electrode materials 12 (i.e. the aforesaid step S18).

Figure 5:
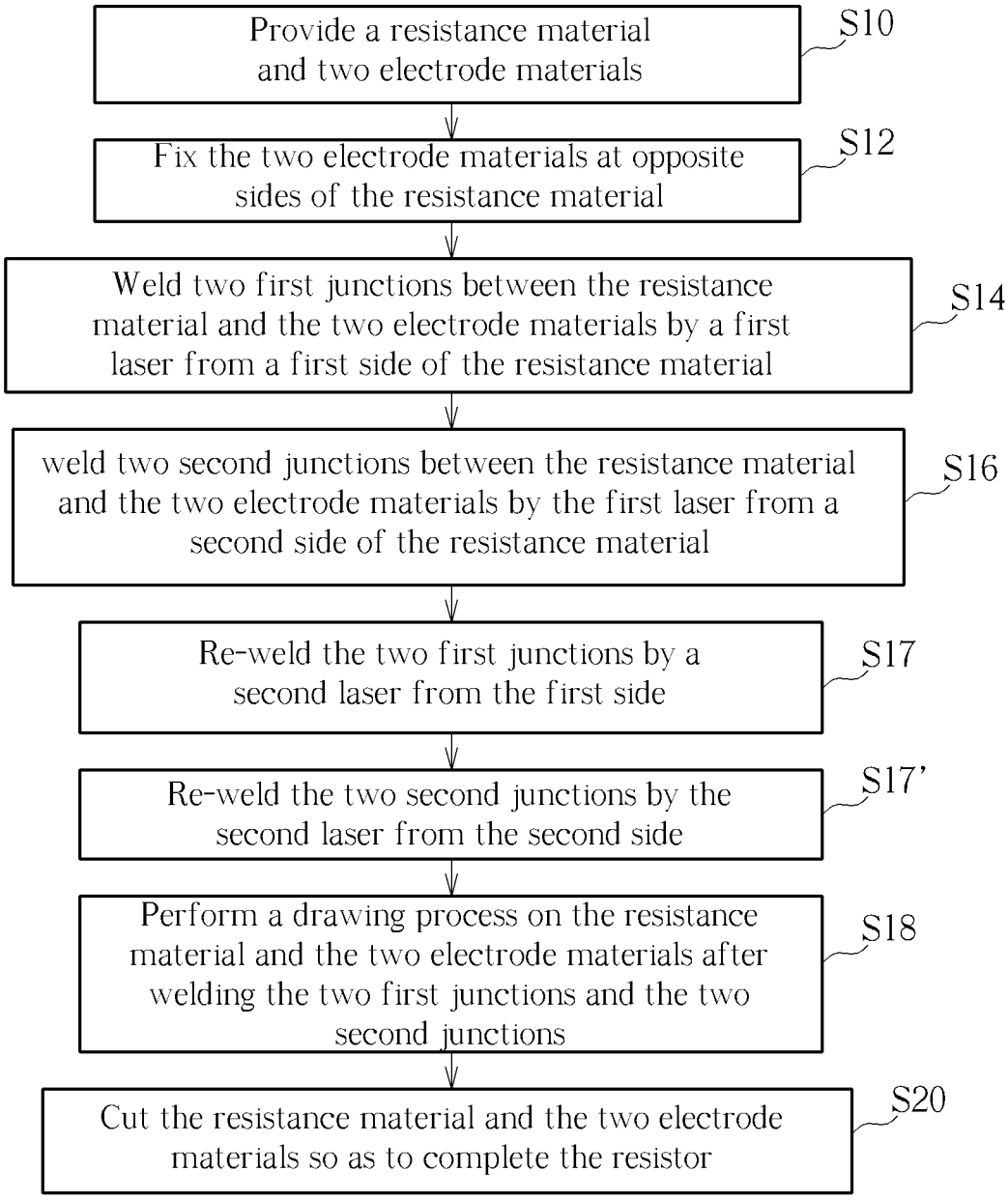
FIG. 5 is a flowchart illustrating a method of manufacturing a resistor according to another embodiment of the invention.
Figure 6A:
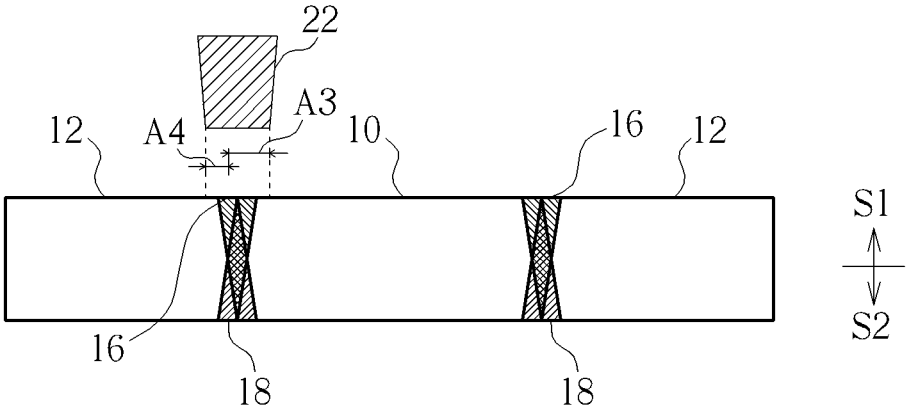
FIGS. 6A and 6B are schematic diagrams illustrating processes associated with steps S17 and S17' shown in FIG. 5.
Figure 6B:
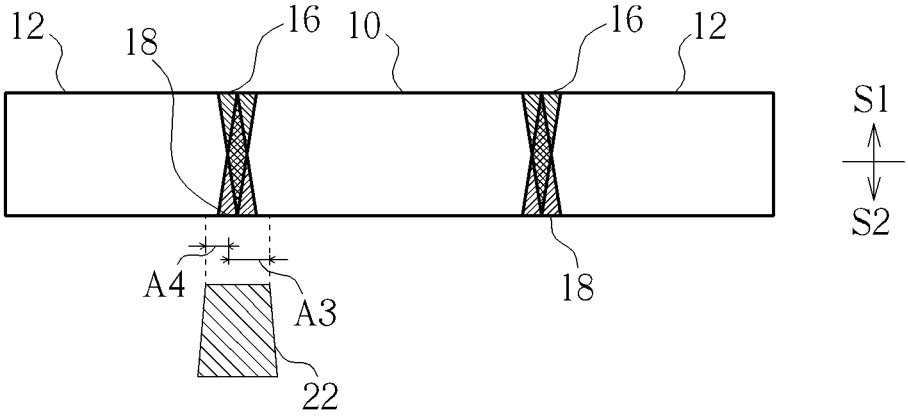

Referring to FIGS. 5 and 6, FIG. 5 is a flowchart illustrating a method of manufacturing a resistor according to another embodiment of the invention, and FIGS. 6A and 6B are schematic diagrams illustrating processes associated with steps S17 and S17' shown in FIG. 5. The main difference between the method shown in FIG. 5 and the method shown in FIG. 1 is that the method shown in FIG. 5 further performs steps S17 and S17' after step S16. Step S17 is performed to re-weld the two first junctions 16 by a second laser 22 from the first side S1 (as shown in FIG. 6A) and Step S17' is performed to re-weld the two second junctions 18 by the second laser 22 from the second side S2 (as shown in FIG. 6B), wherein a beam area A3 from the second laser 22 to the resistance material 10 is larger than a beam area A4 from the second laser 22 to the electrode material 12. It should be noted that the steps S10-S20 shown in FIG. 5 is the same as the steps S10-S20 shown in FIG. 1 and will not be depicted herein again.

In this embodiment, the aforesaid first laser 14 is used to fuse the resistance material 10 and the electrode materials 12 and the second laser 22 is used to flat surfaces of the two first junctions 16 and the two second junctions 18. Accordingly, a spot size of the first laser 14 is smaller than a spot size of the second laser 22 and an output power of the first laser 14 is larger than an output power of the second laser 22. The first laser 14 and the second laser 22 may be pulsed lasers such that a fish-scale pattern is formed on each of the two first junctions 16 and the two second junctions 18 after welding.

Several parameters relative to the first laser 14 and the second laser 22 (e.g. spot size, laser intensity, pulsed frequency, output power, etc.) can be determined based on the resistance material 10 and the electrode materials 12. For example, if the resistance material 10 is MnCu alloy, the electrode materials 12 are Cu, and the resistance material 10 has a large thickness (e.g. larger than 1 mm), the spot size, laser intensity, pulsed frequency and output power of the first laser 14 may be set to be 0.6 mm, 4.0 kW, 6.5 ms and 23 J, respectively, and the spot size, laser intensity, pulsed frequency and output power of the second laser 22 may be set to be 1.35 mm, 4.0 kW, 6.5 ms and 23 J, respectively. In other words, when the resistance material 10 has a large thickness (e.g. larger than 1 mm), the method of the invention can use the first laser 14 to weld the two first junctions 16 and the two second junctions 18 first so as to fuse the resistance material 10 and the electrode materials 12 well and then use the second laser 22 to re-weld the two first junctions 16 and the two second junctions 18 so as to flat surfaces of the two first junctions 16 and the two second junctions 18.

As mentioned in the above, when a laser is used to weld a junction between the resistance material and the electrode material, the invention proposes that the beam area from the laser to the resistance material is larger than the beam area from the laser to the electrode material. Since the reflectivity of the resistance material is smaller than the reflectivity of the electrode material, the resistance material with smaller reflectivity absorbs more laser energy and then transmits heat to the electrode material. The heat, which is transmitted to the electrode material from the resistance material, can be used with laser energy absorbed by the electrode material to weld the electrode material and the resistance material well. Accordingly, the method of the invention is capable of enhancing laser welding intensity between the resistance material and the electrode material of the resistor effectively. Furthermore, the invention can selectively weld the junctions between the resistance material and the electrode materials by the laser from one or two sides of the resistance material according to different resistance materials with different thicknesses, so as to enhance laser welding intensity between the resistance material and the electrode material. Moreover, if the resistance material has a large thickness (e.g. larger than 1 mm), the method of the invention may use a laser with small spot size and large output power to weld the junctions between the resistance material and the electrode materials first and then use another laser with large spot size and small output power to re-weld the junctions between the resistance material and the electrode materials, so as to ensure that the junctions have enough welding intensity and good surface flatness.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method of manufacturing a resistor comprising:

providing a resistance material and two electrode materials, wherein a reflectivity of the resistance material is smaller than a reflectivity of the electrode material;

fixing the two electrode materials at opposite sides of the resistance material; and welding two first junctions between the resistance material and the two electrode materials by a first laser from a first side of the resistance material, wherein a beam area from the first laser to the resistance material is larger than a beam area from the first laser to the electrode material.

2. The method of claim 1, further comprising:

welding two second junctions between the resistance material and the two electrode materials by the first laser from a second side of the resistance material, wherein the second side is opposite to the first side.

3. The method of claim 2, further comprising:

re-welding the two first junctions by a second laser from the first side; and re-welding the two second junctions by the second laser from the second side;

wherein a beam area from the second laser to the resistance material is larger than a beam area from the second laser to the electrode material.

4. The method of claim 3, wherein the first laser and the second laser are pulsed lasers such that a fish-scale pattern is formed on each of the two first junctions and the two second junctions after welding.

5. The method of claim 4, wherein the fish-scale pattern consists of a plurality of molten spots overlapping each other and an overlap rate of the molten spots is smaller than 100% and larger than or equal to 50%.

6. The method of claim 3, wherein a spot size of the first laser is smaller than a spot size of the second laser and an output power of the first laser is larger than an output power of the second laser.

7. The method of claim 2, further comprising:

performing a drawing process on the resistance material and the two electrode materials after welding the two first junctions and the two second junctions.

8. The method of claim 1, wherein the first laser is a pulsed laser such that a fish-scale pattern is formed on the two first junctions after welding.

9. The method of claim 8, wherein the fish-scale pattern consists of a plurality of molten spots overlapping each other and an overlap rate of the molten spots is smaller than 100% and larger than or equal to 50%.

10. The method of claim 1, further comprising:

performing a drawing process on the resistance material and the two electrode materials after welding the two first junctions.

11. A method of manufacturing a resistor comprising:

providing a resistance material and two electrode materials;

fixing the two electrode materials at opposite sides of the resistance material;

welding two first junctions between the resistance material and the two electrode materials by a first laser from a first side of the resistance material; and welding two second junctions between the resistance material and the two electrode materials by the first laser from a second side of the resistance material, wherein the second side is opposite to the first side.

* * * * *